US010856083B2

(12) United States Patent
Cheng et al.

(10) Patent No.: US 10,856,083 B2
(45) Date of Patent: Dec. 1, 2020

(54) DIAPHRAGM AND MINIATURE SPEAKER COMPRISING SAME

(71) Applicant: GOERTEK INC., WeiFang (CN)

(72) Inventors: Zhenzhen Cheng, Weifang (CN); Jianhua Gu, Weifang (CN); Zengxun Wu, Weifang (CN)

(73) Assignee: GOERTEK INC., WeiFang (CN)

( * ) Notice: Subject to any disclaimer, the term of this patent is extended or adjusted under 35 U.S.C. 154(b) by 0 days.

(21) Appl. No.: 16/095,632

(22) PCT Filed: Dec. 28, 2016

(86) PCT No.: PCT/CN2016/112647
§ 371 (c)(1),
(2) Date: Oct. 22, 2018

(87) PCT Pub. No.: WO2017/181718
PCT Pub. Date: Oct. 26, 2017

(65) Prior Publication Data

US 2019/0149924 A1 May 16, 2019

(30) Foreign Application Priority Data

Apr. 22, 2016 (CN) ..... 2016 1 0257697

(51) Int. Cl.
*H04R 25/00* (2006.01)
*H04R 7/12* (2006.01)
*H04R 9/02* (2006.01)

(52) U.S. Cl.
CPC ..... *H04R 7/122* (2013.01); *H04R 7/125* (2013.01); *H04R 9/025* (2013.01); *H04R 2307/025* (2013.01)

(58) Field of Classification Search
CPC ..... H04R 7/122; H04R 7/12; H04R 9/025
(Continued)

(56) References Cited

U.S. PATENT DOCUMENTS 5,217,797 A * 6/1993 Knox ..... B29C 70/086 428/167
7,332,215 B2 * 2/2008 Tokura ..... B32B 5/18 428/318.8

(Continued)

FOREIGN PATENT DOCUMENTS

CN 203661278 U 6/2014
CN 203708461 U 7/2014

(Continued)

OTHER PUBLICATIONS

International Search Report for Application No. PCT/CN2016/112647, dated Mar. 31, 2017.

*Primary Examiner* — Phylesha Dabney

(57) ABSTRACT

The present invention discloses a diaphragm and a miniature speaker comprising the diaphragm. The diaphragm has a multi-layer composite structure comprising alternately stacked thermoplastic elastomer layers and adhesive film layer(s). The diaphragm and the miniature speaker comprising the same solve the technical problems such as an unstable F0 and high total harmonic distortion of the miniature speaker in the prior art. The diaphragm and the miniature speaker according to the invention have low total harmonic distortion, low damping coefficient, higher F0 stability and high sound quality, satisfying requirements for high sound quality of an electronic device.

17 Claims, 1 Drawing Sheet

(58) Field of Classification Search
USPC ..... 381/412; 181/169
See application file for complete search history.

(56) References Cited

U.S. PATENT DOCUMENTS

| | | | | |
|---|---|---|---|---|
| 8,496,086 | B2 * | 7/2013 | Gerkinsmeyer | H04R 7/10 181/169 |
| 9,693,143 | B2 * | 6/2017 | Bohm | H04R 31/003 |
| 9,827,749 | B2 * | 11/2017 | Egger | B32B 7/12 |
| 9,955,266 | B2 * | 4/2018 | Liu | H04R 7/06 |
| 2011/0293114 | A1 | 12/2011 | Akino | |
| 2012/0010698 | A1 * | 1/2012 | Hwang | A61F 2/82 623/1.42 |

FOREIGN PATENT DOCUMENTS

| | | | |
|---|---|---|---|
| CN | 104754472 | A | 7/2015 |
| CN | 105142078 | A | 12/2015 |
| CN | 105933831 | A | 9/2016 |
| CN | 205610915 | U | 9/2016 |
| WO | 2014141390 | A1 | 9/2014 |

* cited by examiner

DIAPHRAGM AND MINIATURE SPEAKER COMPRISING SAME

CROSS-REFERENCE TO RELATED APPLICATIONS

The present specification is a U.S. National Stage of International Patent Application No. PCT/CN2016/112647 filed Dec. 28, 2016, which claims priority to and the benefit of Chinese Patent Application No. 201610257697.X filed on Apr. 22, 2016, the entire contents of which are incorporated herein by reference.

TECHNICAL FIELD

The present invention relates to a technical field of electro-acoustic products, specifically, to a composite diaphragm and a miniature speaker comprising the diaphragm.

BACKGROUND ART

Miniature speaker is an important acoustic component in portable electronic devices and is used to convert electrical signals of acoustic waves into sound signals to transmit to the outside, and the miniature speaker is an energy converter. The miniature speaker generally comprises a vibration system and a magnetic circuit system, the vibration system comprises a diaphragm and a voice coil which are combined together, the diaphragm comprises an edge portion, a suspension ring portion and a dome portion (also known as a reinforcement portion, DOME) which are successively combined from outside to inside, the diaphragm is an important component of the miniature speaker, plays a crucial role in the acoustic performance of the miniature speaker, and determines the conversion quality of the miniature speaker from electric energy to sound energy.

The existing diaphragm is generally made of a single-layer TPU (Thermoplastic polyurethanes, Thermoplastic polyurethane elastomers) or TPEE (Thermoplastic polyester elastomers) film, this kind of diaphragm has poor heat resistance, poor rigidity and low damping and is easy to deform, which results in poor stability of F0 (resonant frequency), high total harmonic distortion and poor sound quality of the miniature speaker, therefore, it is difficult to meet people's requirements for high sound quality of an electronic device.

SUMMARY

Technical Problem

In view of the above defects, the technical problem to be solved by the present invention is to provide a diaphragm which has good heat resistance, is not easy to deform, can improve the F0 stability of a miniature speaker and can reduce the total harmonic distortion of the miniature speaker, and to provide a miniature speaker which has high F0 stability, low total harmonic distortion and high sound quality, and can meet people's requirements for high sound quality of electronic devices.

Technical Solution

A diaphragm, the diaphragm has a multi-layer composite structure comprising thermoplastic elastomer layers and adhesive film layer(s) which are alternately laminated.

Wherein, in the multi-layer composite structure, two outermost layers are thermoplastic elastomer layers, and each of the adhesive film layer(s) is sandwiched between two adjacent thermoplastic elastomer layers.

As an implementation, the multi-layer composite structure is composed of three layers consisting of two thermoplastic elastomer layers and one adhesive film layer located between the two thermoplastic elastomer layers.

As another implementation, the multi-layer composite structure is composed of five layers consisting of three thermoplastic elastomer layers and two adhesive film layers located between two adjacent thermoplastic elastomer layers of the three thermoplastic elastomer layers respectively.

As still another implementation, the multi-layer composite structure is composed of seven layers consisting of four thermoplastic elastomer layers and three adhesive film layers located between two adjacent thermoplastic elastomer layers of the four thermoplastic elastomer layers respectively.

Wherein, each of the thermoplastic elastomer layers is one or more of TPEE film, TPU film and TPAE film.

Wherein, each of the thermoplastic elastomer layers has a thickness of 5 μm to 100 μm, and a young's modulus of 50 MPa to 500 Mpa.

Wherein, each of the adhesive film layer(s) is one or more of acrylic adhesive film and silica gel film.

Wherein, each of the adhesive film layer(s) has a thickness of 1 μm to 100 μm.

Wherein, the diaphragm has a thickness of 10 μm to 300 μm.

Wherein, each layer of the diaphragm comprises a reinforcement portion located at center, a suspension ring portion surrounding the reinforcement portion, and an edge portion provided at an edge of the suspension ring portion, wherein, each of the reinforcement portion, the suspension ring portion and the edge portion has a multi-layer composite structure comprising the thermoplastic elastomer layers and the adhesive film layer(s) which are alternately laminated.

A miniature speaker comprises a vibration system and a magnetic circuit system, the vibration system comprises a diaphragm and a voice coil which are combined together, and the diaphragm is any one of the above-mentioned diaphragms.

Technical Effect

The diaphragm of the present invention has the multi-layer composite structure comprising the thermoplastic elastomer layer and the adhesive film layer which are alternately laminated. The thermoplastic elastomer layer provides strength for vibration of the diaphragm; however, the damping performance of single thermoplastic elastomer layer is poor, and the vibration balance of single thermoplastic elastomer layer is insufficient, the adhesive film layer can provide higher damping for the whole system. This kind of diaphragm composed of the thermoplastic elastomer layer and the adhesive film layer which are alternately laminated has simpler process, large rigidity and high heat resistance, which can effectively improve the damping of miniature speaker, reduce the total harmonic distortion and the damping coefficient of the miniature speaker, maintain the long-term stability of F0, and greatly improve the sound quality of the miniature speaker.

Since the diaphragm of the miniature speaker of the present invention is the above-mentioned diaphragm, the total harmonic distortion and damping coefficient are reduced, the stability of F0 is higher, the sound quality is higher, and people's requirements for high sound quality of electronic devices can be met. To sum up, the diaphragm of the present invention and the miniature speaker provided with the diaphragm can solve the technical problems of such as an unstable F0 and high total harmonic distortion of the miniature speaker in the prior art; and the diaphragm of the present invention and the miniature speaker provided with the diaphragm have low total harmonic distortion, low damping coefficient, higher F0 stability and high sound quality, and can meet people's requirements for high sound quality of the electronic device.

REFERENCE NUMERALS IN THE DRAWINGS

Figure 1:
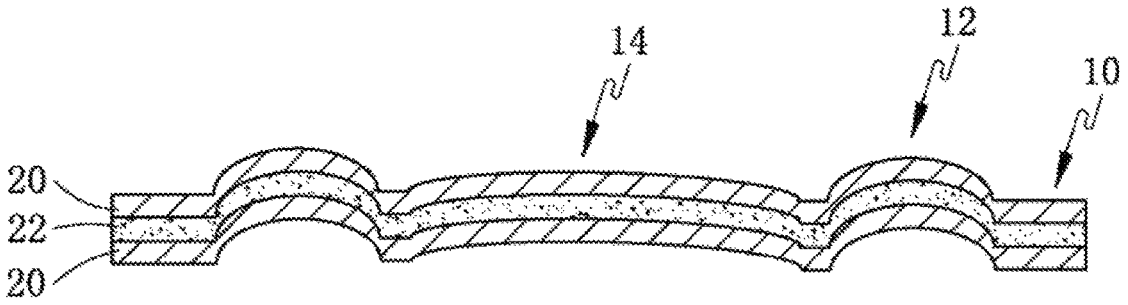
FIG. 1 is a schematic diagram of the sectional structure of the diaphragm of the first embodiment of the present invention.

10, edge portion; 12, suspension ring portion; 14, reinforcement portion; 20, thermoplastic elastomer layer; 22, adhesive film layer.

DETAILED DESCRIPTION OF EMBODIMENTS

Hereinafter, the present invention is further illustrated in conjunction with the accompanying drawings and the embodiments.

A diaphragm comprises a reinforcement portion 14, a suspension ring portion 12 and an edge portion 10 which are successively combined from inside to outside. The diaphragm has a multi-layer composite structure, which comprises thermoplastic elastomer layers and adhesive film layer(s) which are alternately laminated.

The multi-layer composite structure comprising the thermoplastic elastomer layers and the adhesive film layer(s) which are alternately laminated can achieve higher strength and higher damping simultaneously, and the process thereof is simpler.

Preferably, in the multi-layer composite structure, the two outermost layers are thermoplastic elastomer layers, and each of the adhesive film layer(s) is sandwiched between two adjacent thermoplastic elastomer layers. From the point of view of process technology, if the outermost layer is the adhesive film layer, the process control is more difficult (for example, it is easy to adhere to impurities, etc.), the diaphragm will be adhered to the mold during molding, the diaphragm will be adhered to the washer or the front cover under high-power or large displacement, which will cause defects; on the whole, if the outermost layer is the adhesive film layer, the practicability is low, and the problem of adhesion will not occur when the two outermost layers are set as the thermoplastic elastomer layers.

The total thickness of the multi-layer composite structure is 10 μm to 300 μm, preferably, 20 μm to 200 μm. If the total thickness is larger than 300 μm, the vibration space of the product decreases, the margin of the maximum linear displacement decreases, and the F0 of the product is too high; if the total thickness is less than 10 μm, the strength of the product is low, the F0 is too low, the damping performance is poor, the temperature resistance is poor, and the reliability margin is low.

The thermoplastic elastomer layer is one or more of TPEE film, TPU film and TPAE (thermoplastic polyamide elastomer) film, but not limited to the above three kinds. Compared with other elastomers, TPEE, TPU, TPAE have higher strength, better resilience, higher temperature resistance, are easy to mold, and have excellent dimensional stability of product after molding. The thickness of the thermoplastic elastomer layer is 5 μm to 100 μm, preferably, 5 μm to 50 μm, and more preferably, 10 μm to 50 μm, the thicker the thermoplastic elastomer layer, the higher the modulus and the higher the F0 of the product. If the thickness of thermoplastic elastomer layer is less than 5 μm, the strength of the diaphragm product is insufficient; and if the thickness is larger than 100 μm, the vibration mass is too large, the sensitivity loss of the product is too large, and the vibration space is weakened. The young's modulus of the thermoplastic elastomer layer is 50 MPa to 500 Mpa, preferably, 80 MPa to 350 Mpa. Young's modulus is a physical quantity describing the resistance to deformation of solid materials, it measures the stiffness of an isotropic elastomer. If the young's modulus is lower than 50 MPa, the strength of the product is insufficient, and if the young's modulus is higher than 500 Mpa, the product loses elasticity, and the resilience of the product is insufficient.

The adhesive film layer is one or more of acrylic adhesive film and silica gel film, but not limited to the above two kinds. The thickness of the adhesive film layer is 1 μm to 100 μm, preferably, 1 μm to 50 μm, and more preferably, 2 μm to 50 μm. Acrylic adhesive or silica gel has better damping, better adhesion, better temperature resistance and better thickness consistency than other kinds of adhesive, it can improve the damping performance of the product as a whole, reduce acoustic distortion and ensure the reliability of the product. If the thickness is larger than 100 μm, the resilience of the diaphragm becomes worse, the strength of the diaphragm decreases, and if the thickness is less than 1 μm, the adhesive force is weak, and the damping performance is insufficient.

Preferably, the reinforcement portion 14 is located at the center of the diaphragm, can act as a stopper when the loudspeaker is overloaded and can prevent the amplitude of the vibration system from being too large. The suspension ring portion 12 surrounds the reinforcement portion 14, the edge portion 10 is provided at the edge of the suspension ring portion 12, and each of the reinforcement portion 14, the suspension ring portion 12 and the edge portion 10 has a multi-layer composite structure comprising the thermoplastic elastomer layers and the adhesive film layer(s) which are alternately laminated.

Hereinafter, the above technical solutions are further outlined in conjunction with several specific embodiments.

The First Embodiment

As shown in FIG. 1, the diaphragm has a three-layer composite structure consisting of two thermoplastic elastomer layers 20 and one adhesive film layer 22, the thermoplastic elastomer layers 20 are located at the surface, and the adhesive film layer 22 is sandwiched between the two thermoplastic elastomer layers 20. Wherein, the two thermoplastic elastomer layers 20 can be made of the same material, for example, one of TPEE film, TPU film or TPAE film, alternatively, can also be made of two different materials, for example, TPEE film and TPU film, or TPU film and TPAE film; the adhesive film layer 22 is made of one of acrylic adhesive film or silica gel film.

The Second Embodiment

Figure 2:
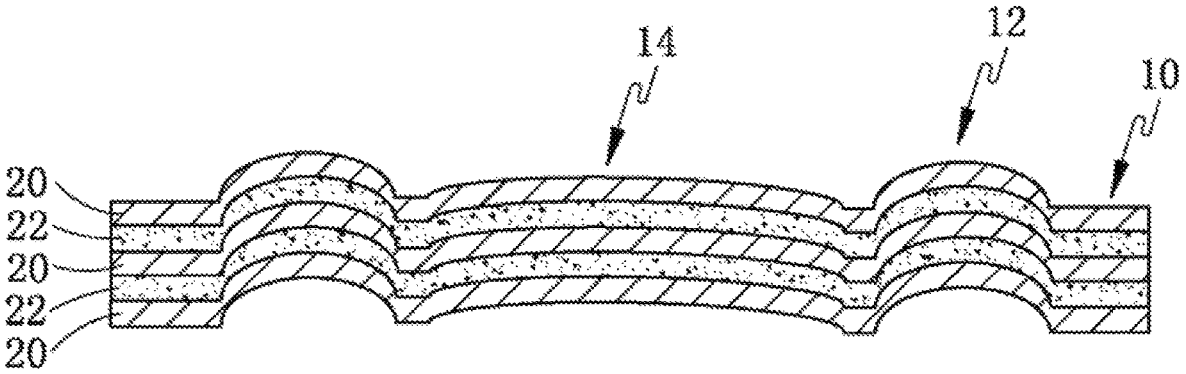
FIG. 2 is a schematic diagram of the sectional structure of the diaphragm of the second embodiment of the present invention.

As shown in FIG. 2, the diaphragm has a five-layer composite structure consisting of three thermoplastic elastomer layers 20 and two adhesive film layers 22, the thermoplastic elastomer layers 20 are still located at the surface, and the adhesive film layers 22 are located at the middle and are alternately laminated with the thermoplastic elastomer layers 20. Wherein, the three thermoplastic elastomer layers 20 can be made of the same material, for example, one of TPEE film, TPU film or TPAE film, alternatively, can also be made of two different materials or three different materials of them; the two adhesive film layers 22 can be made of the same material, for example, one of acrylic adhesive film or silica gel film, alternatively, can also be made of two different materials, that is, one layer is acrylic adhesive film, the other layer is silica gel film.

The Third Embodiment

Figure 3:
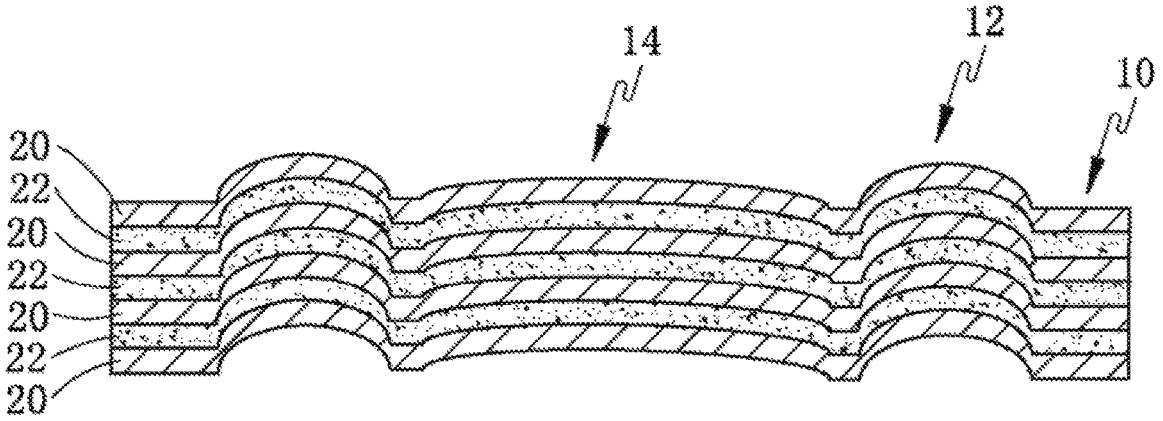
FIG. 3 is a schematic diagram of the sectional structure of the diaphragm of the third embodiment of the present invention.

As shown in FIG. 3, the diaphragm has a seven-layer composite structure consisting of four thermoplastic elastomer layers 20 and three adhesive film layers 22. As in the above two embodiments, the four thermoplastic elastomer layers 20 can be made of the same material or different materials; the three adhesive film layers 22 can also be made of the same material or different materials.

The more layers, the more complex the technology and the process and the higher the requirements for a single layer of raw materials, such as thickness consistency; the more layers, the more flexible the acoustic performance adjustment and the greater the reliability margin of the diaphragm. Therefore, preferably, the multi-layer composite structure is composed of three layers to seven layers.

The diaphragm of the present invention is composed of the thermoplastic elastomer layer and the adhesive film layer, has high rigidity and strong heat resistance, and can effectively improve the damping of the miniature speaker, reduce the total harmonic distortion and damping coefficient of the miniature speaker, maintain the long-term stability of F0, and greatly improve the sound quality of the miniature speaker.

A miniature speaker comprising any one of the above-mentioned diaphragms comprises a vibration system and a magnetic circuit system, the vibration system comprises the diaphragm and a voice coil combined together, and the diaphragm is the above-mentioned diaphragm composed of the thermoplastic elastomer layer and the adhesive film layer.

Since the miniature speaker of the present invention adopts the above-mentioned composite diaphragm, the total harmonic distortion and the damping coefficient are reduced, the stability of F0 is higher, the sound quality is higher, and the requirements for high sound quality of electronic devices can be met.

The present invention is not limited to the above-mentioned specific embodiments, and various modifications made by those skilled in the art based on the above concept without creative labor are included within the protection scope of the present invention.

The invention claimed is:

1. A diaphragm, wherein the diaphragm has a multi-layer composite structure comprising thermoplastic elastomer layers and one or more adhesive film layer which are alternately laminated, wherein in the multi-layer composite structure, two outermost layers are thermoplastic elastomer layers, and every layer of the one or more adhesive film layer is sandwiched between two adjacent thermoplastic elastomer layers, and wherein each of the thermoplastic elastomer layers is one or more of thermoplastic polyester (TPEE) film, thermoplastic polyurethane (TPU) film and thermoplastic polyamide elastomer (TPAE) film, wherein the diaphragm is for a miniature speaker.

2. The diaphragm of claim 1, wherein the multi-layer composite structure is composed of three layers consisting of two thermoplastic elastomer layers and one adhesive film layer located between the two thermoplastic elastomer layers.

3. The diaphragm of claim 1, wherein the multi-layer composite structure is composed of five layers consisting of three thermoplastic elastomer layers and two adhesive film layers located between two adjacent thermoplastic elastomer layers of the three thermoplastic elastomer layers respectively.

4. The diaphragm of claim 1, wherein the multi-layer composite structure is composed of seven layers consisting of four thermoplastic elastomer layers and three adhesive film layers located between two adjacent thermoplastic elastomer layers of the four thermoplastic elastomer layers respectively.

5. The diaphragm of claim 1, wherein each of the thermoplastic elastomer layers has a thickness of 5 μm to 100 μm and a young's modulus of 50 MPa to 500 Mpa.

6. The diaphragm of claim 1, wherein every layer of the one or more adhesive film layer has a thickness of lμm to 100 μm.

7. The diaphragm of claim 1, wherein the diaphragm has a total thickness of 10 μm to 300 μm.

8. A miniature speaker, comprising a vibration system and a magnetic circuit system, wherein the vibration system comprises a diaphragm and a voice coil which are combined together, and wherein the diaphragm is the diaphragm of claim 1.

9. The miniature speaker of claim 8, wherein the multi-layer composite structure is composed of three layers consisting of two thermoplastic elastomer layers and one adhesive film layer located between the two thermoplastic elastomer layers.

10. The miniature speaker of claim 8, wherein the multi-layer composite structure is composed of five layers consisting of three thermoplastic elastomer layers and two adhesive film layers located between two adjacent thermoplastic elastomer layers of the three thermoplastic elastomer layers respectively.

11. The miniature speaker of claim 8, wherein the multi-layer composite structure is composed of seven layers consisting of four thermoplastic elastomer layers and three adhesive film layers located between two adjacent thermoplastic elastomer layers of the four thermoplastic elastomer layers respectively.

12. The diaphragm of claim 1, wherein each layer of the diaphragm comprises a reinforcement portion located at center, a suspension ring portion surrounding the reinforcement portion, and an edge portion provided at an edge of the suspension ring portion, wherein each of the reinforcement portion, the suspension ring portion and the edge portion has a multi-layer composite structure comprising the thermoplastic elastomer layers and the one or more adhesive film layer which are alternately laminated.

13. The diaphragm of claim 1, wherein every layer of the one or more adhesive film layer is one or more of acrylic adhesive film and silica gel film.

14. A diaphragm, wherein the diaphragm has a multi-layer composite structure comprising thermoplastic elastomer layers and one or more adhesive film layer which are alternately laminated, wherein the multi-layer composite structure is composed of three layers consisting of two thermoplastic elastomer layers and one adhesive film layer located between the two thermoplastic elastomer layers, or the multi-layer composite structure is composed of five layers consisting of three thermoplastic elastomer layers and two adhesive film layers located between two adjacent thermoplastic elastomer layers of the three thermoplastic elastomer layers respectively, or the multi-layer composite structure is composed of seven layers consisting of four thermoplastic elastomer layers and three adhesive film layers located between two adjacent thermoplastic elastomer layers of the four thermoplastic elastomer layers respectively, wherein in the multi-layer composite structure, two outermost layers are thermoplastic elastomer layers, and every layer of the one or more adhesive film layer is sandwiched between two adjacent thermoplastic elastomer layers, and wherein each of the thermoplastic elastomer layers is one or more of thermoplastic polyester (TPEE) film, thermoplastic polyurethane (TPU) film and thermoplastic polyamide elastomer (TPAE) film, wherein the diaphragm is for a miniature speaker.

15. The diaphragm of claim 14, wherein each of the thermoplastic elastomer layers has a thickness of 5 μm to 100 μm and a young's modulus of 50 MPa to 500 Mpa.

16. The diaphragm of claim 14, wherein every layer of the one or more adhesive film layer has a thickness of 1 μm to 100 μm.

17. The diaphragm of claim 14, wherein the diaphragm has a total thickness of 10 μm to 300 μm.

* * * * *